US007273251B2

(12) United States Patent
Real et al.

(10) Patent No.: US 7,273,251 B2
(45) Date of Patent: Sep. 25, 2007

(54) VIDEO GAME CHAIR

(75) Inventors: James K. Real, Mesa, AZ (US); Richard Edward Florez, Jr., Pittsburg, CA (US)

(73) Assignee: Ultimate Game Chair, Antioch, CA (US)

( * ) Notice: Subject to any disclaimer, the term of this patent is extended or adjusted under 35 U.S.C. 154(b) by 0 days.

(21) Appl. No.: 11/483,307

(22) Filed: Jul. 7, 2006

(65) Prior Publication Data

US 2006/0284459 A1 Dec. 21, 2006

Related U.S. Application Data

(63) Continuation of application No. 10/770,960, filed on Feb. 3, 2004, now Pat. No. 7,125,074.

(51) Int. Cl.
*A63F 13/02* (2006.01)

(52) U.S. Cl. ..... 297/217.3; 273/148 B; 463/30; 463/47

(58) Field of Classification Search ..... 297/217.3; 273/148 B, 460; 472/130; 463/36–38, 46, 463/47, 30

See application file for complete search history.

(56) References Cited

U.S. PATENT DOCUMENTS 5,195,746 A * 3/1993 Boyd et al. ..... 463/37
5,368,484 A * 11/1994 Copperman et al. ..... 434/69
5,515,078 A * 5/1996 Greschler et al. ..... 345/156
5,553,148 A * 9/1996 Werle ..... 381/300
5,624,156 A 4/1997 Leal et al.
5,669,818 A * 9/1997 Thorner et al. ..... 463/30
5,807,177 A 9/1998 Takemoto et al.
5,842,715 A 12/1998 Jones
5,868,687 A 2/1999 Tedesco
5,920,034 A 7/1999 Saka et al.
5,938,282 A 8/1999 Epple
6,145,926 A 11/2000 Lin
6,206,464 B1 3/2001 Santa Rosa et al.
6,216,927 B1 4/2001 Meritt
6,315,673 B1 * 11/2001 Kopera et al. ..... 472/60
6,422,941 B1 * 7/2002 Thorner et al. ..... 463/30
6,575,836 B1 * 6/2003 Nishimura ..... 463/46
6,752,716 B1 * 6/2004 Nishimura et al. ..... 463/6
6,814,709 B2 11/2004 Schwartz et al.
2001/0026087 A1 10/2001 Tomita
2003/0057749 A1 3/2003 Buono

OTHER PUBLICATIONS

International Search Report, Ultimate Game Chair, PCT/US05/03257, dated May 10, 2005, 3 pages.

* cited by examiner

*Primary Examiner*—Peter R. Brown
(74) *Attorney, Agent, or Firm*—Marc A. Sockol; Thelen Reid Brown Raysman & Steiner LLP

(57) ABSTRACT

A video game chair for enhancing the enjoyment of a video game includes a chair member formed of a horizontal seat portion with a backrest portion vertically extending therefrom. Adjacent each of two opposing sides of the seat portion is an adjustable arm with a game controller mounted thereon. A speaker and adjustable leg are mounted adjacent each of two opposing sides of the backrest portion. An interface box is removably attached to a lower surface of the seat portion for electrically connecting the speakers and controller to a conventional game box.

18 Claims, 4 Drawing Sheets

VIDEO GAME CHAIR

PRIORITY CLAIM

This application is a continuation of and hereby incorporates by reference U.S. patent application Ser. No. 10/770,960, by inventors J. Real and R. Florez, filed on Feb. 3, 2004 now U.S. Pat. No. 7,125,074, entitled "Video Game Chair."

BACKGROUND OF THE INVENTION

The present invention relates to a uniquely designed chair that enhances the comfort and experience of a video game player.

DESCRIPTION OF THE PRIOR ART

Video games have long been a popular form of entertainment. The games are typically operated by one or more controllers which are either held in one's hands or are supported on a table, floor or other surface. Manipulating such controllers is cumbersome and uncomfortable for the operator. Accordingly, there is currently a need for a device that allows a user to more conveniently operate a video game. The present invention satisfies this problem by providing a uniquely designed chair that allows a user to comfortably operate and enjoy a video game.

SUMMARY OF THE INVENTION

The present invention relates to a chair specifically designed to enhance the experience of a video game player. The device comprises a chair member including a horizontal seat portion with a backrest portion vertically extending therefrom. Both the seat portion and backrest portion are preferably encapsulated with a padded foam material for enhanced comfort. Adjacent each of two opposing side edges of the seat portion is a tubular frame member with a padded armrest mounted thereon. Attached to each frame member is an elongated adjustable arm having a game controller mounted thereon. Mounted along each of two opposing side edges of the backrest portion is an elongated adjustable leg having a speaker mounted on an upper end thereof. The speakers are suspended at a height typically corresponding to that of a player's ears when the player is seated in the chair.

A game interface box is mounted on the lower surface of the seat portion. The interface box is received within a protective case having straps secured thereto allowing the case to be removed from the seat portion, if desired. The case includes a releasable flap that selectively exposes a plurality of interface jacks. Embedded within the seat portion and/or backrest portion are vibrating pads that are electrically connected to the interface box. The game controller and speakers are likewise in communication with the interface box via cables that extend through the respective adjustable arms and legs. The interface box also includes a select jack for connecting the box to a conventional game controller. Accordingly, the armrest mounted game controllers can then be used to control the various functions associated with the video game. Furthermore, the various special effects emitted by the game box will be directed to the chair via the interface box. For example, any sounds associated with the video game will be emitted through the speakers. Additionally, if the game or game box includes means for creating a vibration, an appropriate signal will be directed to the vibrating pads via the interface box to cause a vibration within the seat and/or backrest portions.

It is therefore an object of the present invention to provide a game chair that significantly enhances a video game player's experience.

It is another object of the present invention to provide a game chair that provides a relaxing and comfortable means for playing a video game.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
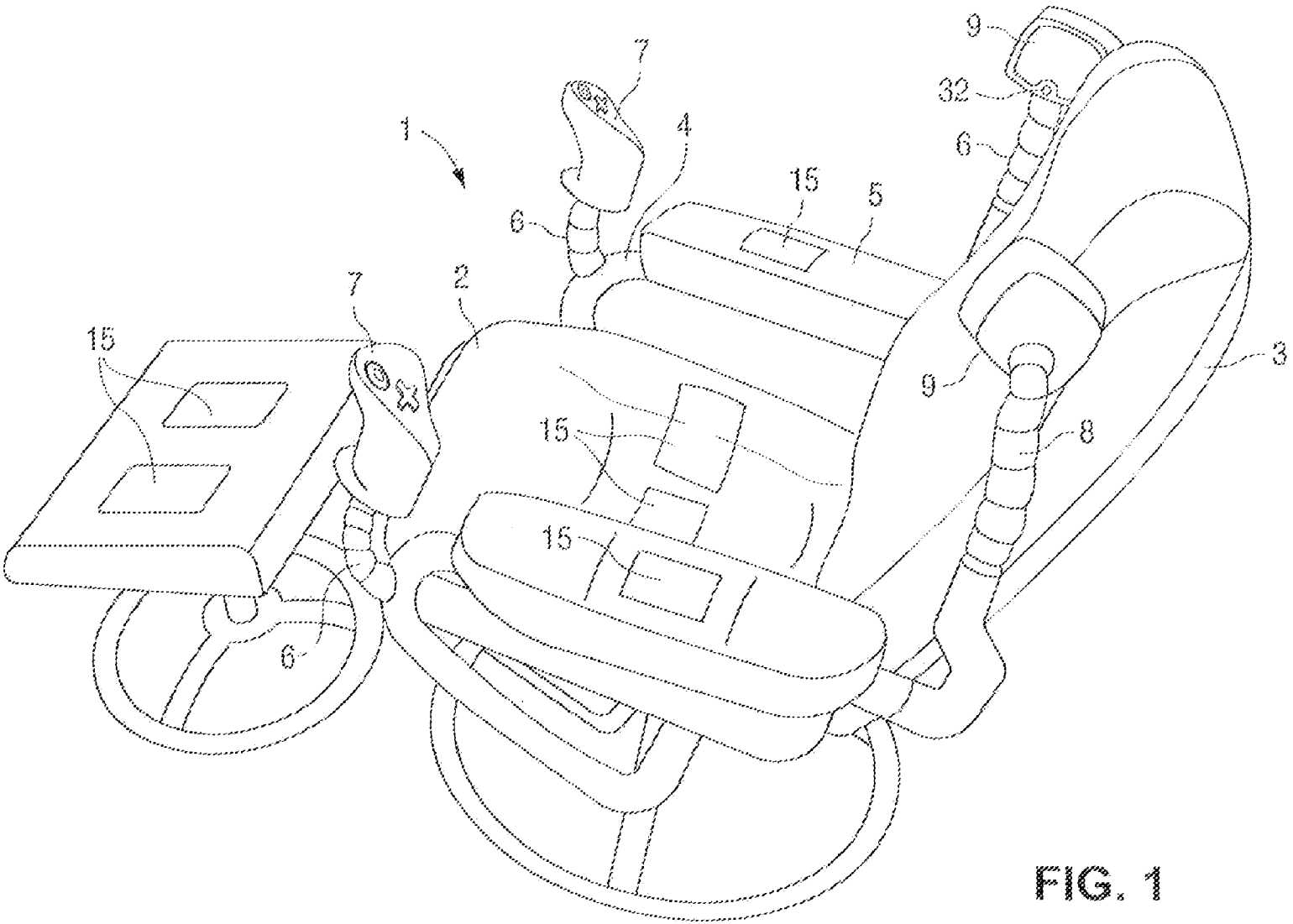
FIG. 1 is a perspective view of the game chair.
Figure 2:
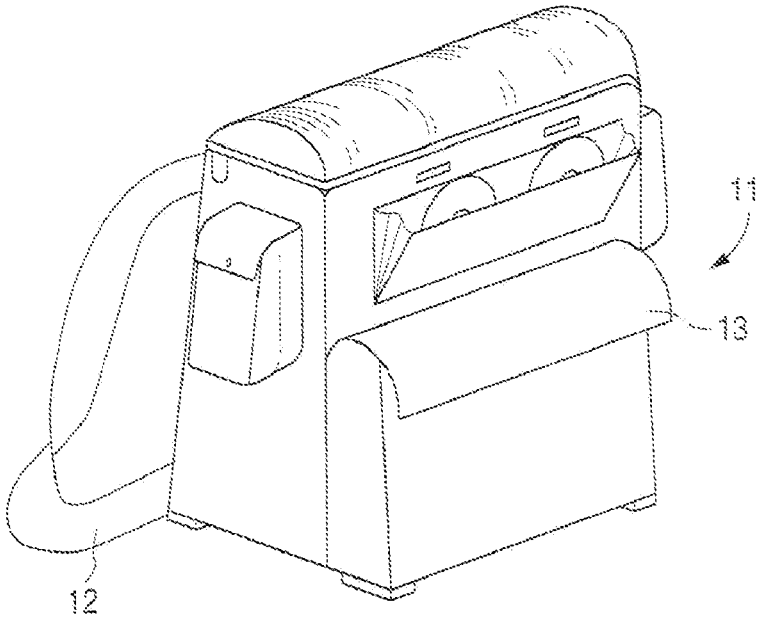
FIG. 2 depicts the game interface box received within its protective case.
Figure 4:
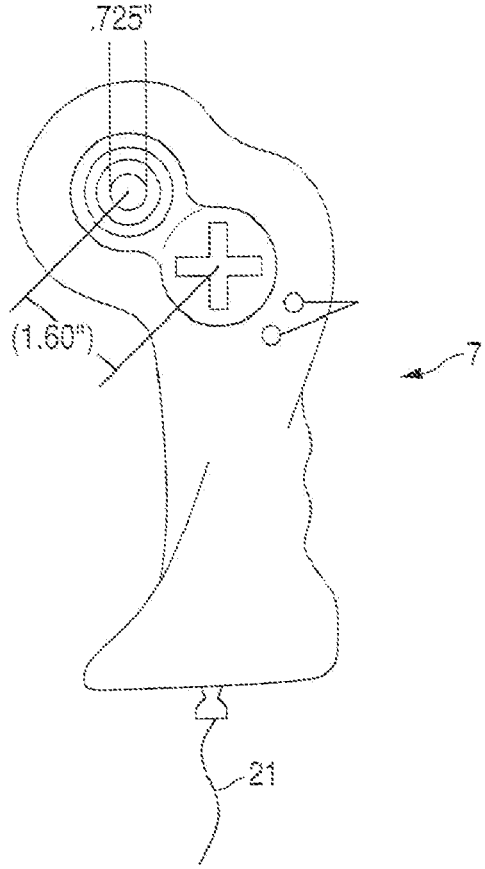
FIG. 4 is a plan view of a game controller according to the present invention.
Figure 3:
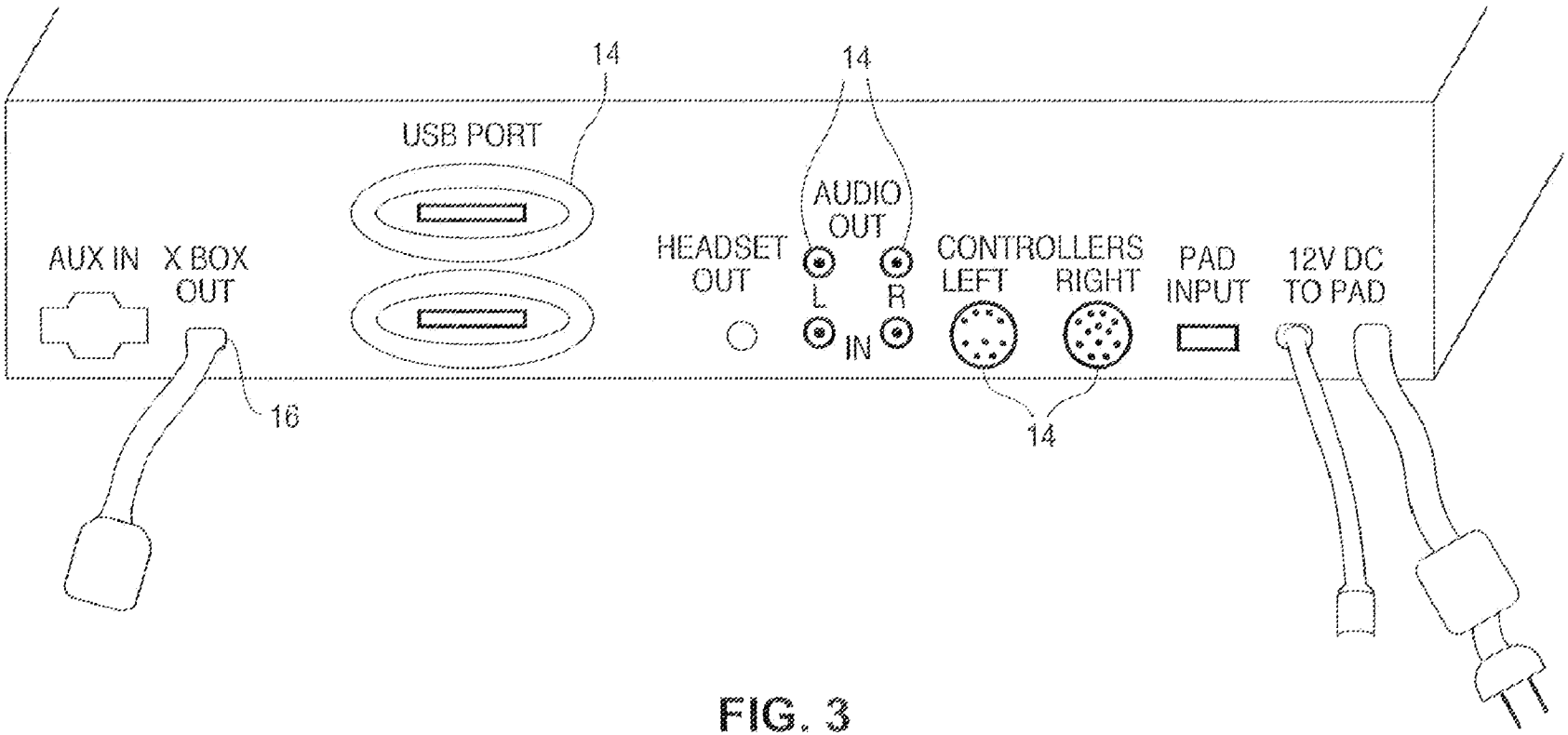
FIG. 3 is a partial view of the interface box depicting the various interface jacks.
Figure 5:
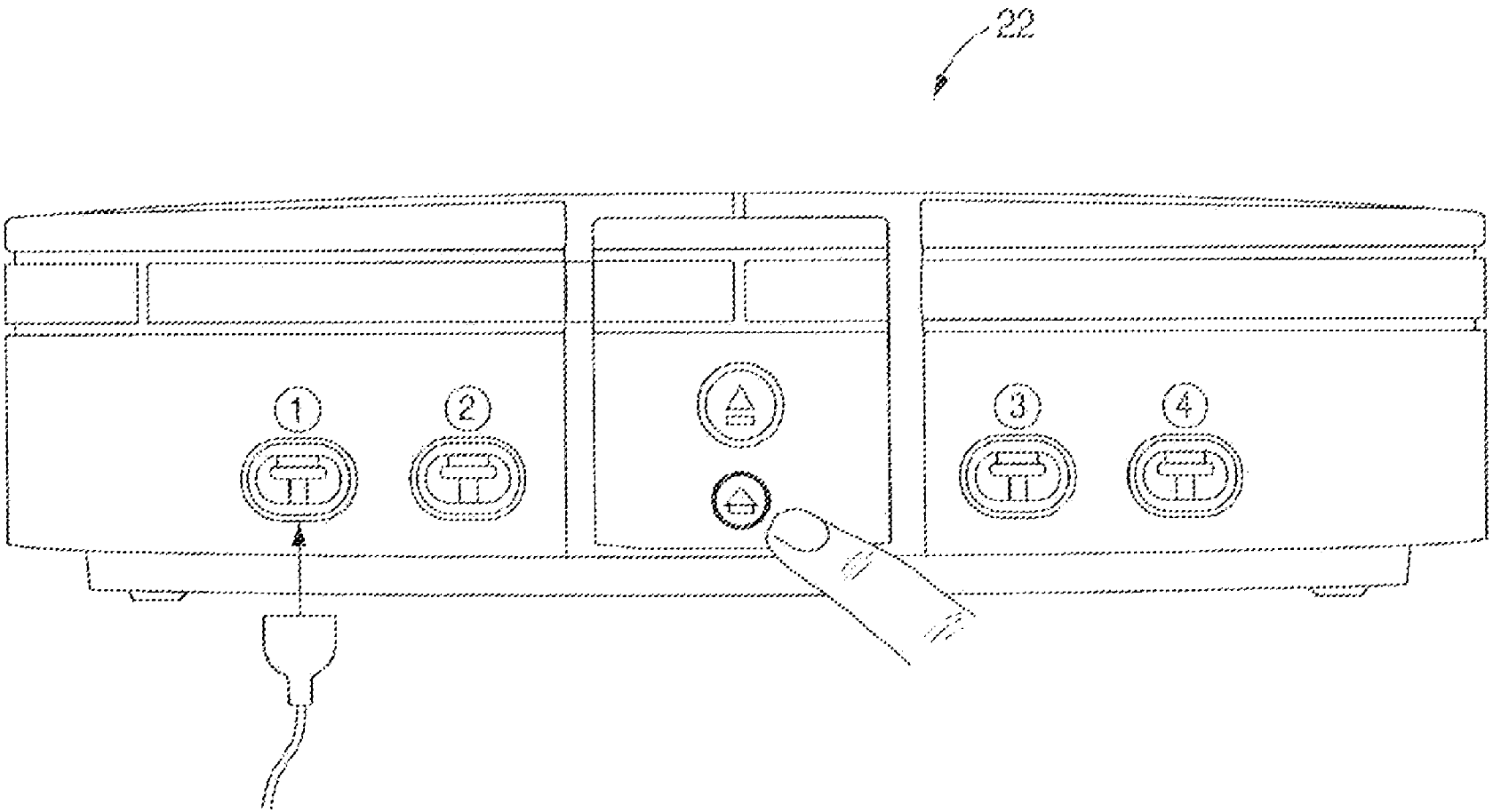
FIG. 5 depicts a typical game box for use with a game chair according to the present invention.

The present invention relates to a chair specifically designed to enhance the experience of a video game player. The device comprises a chair member 1 including a horizontal seat portion 2 with a backrest portion 3 vertically extending therefrom. Both the seat portion and backrest portion are preferably encapsulated with a padded foam material for enhanced comfort.

Adjacent each of two opposing side edges of the seat portion is a tubular frame member 4 with a padded armrest 5 mounted thereon. Attached to each frame member is an elongated adjustable arm 6 having a conventional game controller 7 mounted thereon. Each controller includes a ball on a lower surface thereof that snaps into a mating receptacle on the arm. The adjustable arm is conventional and includes multiple interlinked segments each fixable in a select position relative to an adjacent segment allowing the orientation of the arm to be varied and fixed in the selected position.

Extending from a rear end of each armrest is an elongated adjustable leg 8 having a speaker 9 mounted on an upper end thereof. The speakers are suspended at a height generally corresponding to that of a player's ears when the player is seated in the chair. A game interface box 10 is mounted on the lower surface of the seat portion. The interface box is received within a protective case 11 having straps 12 secured thereto allowing the case to be removably attached to the seat portion. The case includes a releasable flap 13 that selectively exposes a plurality of interface jacks 14.

Many conventional video game controllers include a vibrating pad received therein that is activated by a video game box upon the occurrence of a predetermined game event. The intensity of the vibration varies according to a select game being played and/or the event that is occurring. Similarly, the present invention includes vibrating pads 15 embedded within the seat portion and/or backrest portion that are electrically connected to the interface box. Preferably, multiple vibrating pads are included that are activated according to the signal received from the game box. For example, a minimum signal can activate one or more pads, while an intermediate signal will simultaneously activate additional pads. Finally, a maximum signal will activate all pads. Similar varying intensity vibrators are included in the controllers.

The game controllers and speakers are likewise in communication with the interface box via cables 21 that extend through the respective adjustable arms and legs. The interface box also includes a select jack 16 for connecting the box to a conventional game controller 22. Accordingly, the armrest mounted game controllers can then be used to control the various functions associated with the video game. Furthermore, the various special effects emitted by the game box will be directed to the chair via the interface box. For example, any sounds associated with the video game will be emitted through the speakers. Additionally, if the game or game box includes means for creating a vibration, an appropriate signal will be directed to the vibrating pads and controllers via the interface box to cause a vibration within the chair or controllers.

The interface box will also include auxiliary jacks for connecting various accessory items such as headphones, steering wheels, flight controls, shooting accessories, vibrating armrests or vibrating ottomans. Furthermore, LED'S 32 can be mounted on the chair member, preferably on the speakers, which are activated simultaneously with the vibrating pads. One or more cup holders may also be included.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A video game chair, comprising:

a chair;

a vibrating mechanism coupled to the chair; and an interface box having one or more interface jacks and capable of being electrically coupled to the vibrating mechanism and to a video game box, the interface box capable of intercepting game-controller vibration-feedback control signals from the video game box in response to game events and of activating the vibrating mechanism in response to the game-controller vibration-feedback control signals.

2. A video game chair as in claim 1, wherein the vibrating mechanism includes one or more vibrators, each vibrator being associated with one or more vibration intensity levels and capable of vibrating at a particular vibration intensity level when activated.

3. A video game chair as in claim 1, wherein the vibrating mechanism includes one or more vibrators, the electrical game-controller vibration-feedback control signal including one or more of a minimum signal, an intermediate signal, and a maximum signal, the minimum signal capable of activating a small number of the one or more vibrators, the maximum signal capable of activating all of the one or more vibrators, and the intermediate signal capable of activating an intermediate number of the one or more vibrators, the small number being at least one, the intermediate number being equal to or greater than the small number.

4. A video game chair as in claim 1, wherein the vibrating mechanism includes one or more vibrators included in a game controller.

5. A video game chair as in claim 1, further comprising an ottoman, the vibrating mechanism being further coupled to the ottoman.

6. A video game chair as in claim 1, further comprising an audio mechanism coupled to the chair, the interface box being further capable of activating the audio mechanism in response to the electrical game-controller vibration-feedback control signal.

7. A video game chair as in claim 1, further comprising a visual mechanism coupled to the chair, the interface box being further capable of activating the visual mechanism in response to the electrical game-controller vibration-feedback control signal.

8. A video game chair as in claim 7, wherein the visual mechanism includes on or more LEDs.

9. A video game chair as in claim 1, further comprising a protective case capable of housing the interface box, the protective case allowing for selectively exposing the one or more interface jacks.

10. A video game chair as in claim 1, wherein the interface box is further capable of being disposed in a protective case, the protective case capable of being coupled to the chair.

11. A method comprising:

sending game controller signals by game controllers to a video game box to control game play, the video game box generating an electrical game-controller vibration-feedback control signal in response to the game play;

intercepting the electrical game-controller vibration-feedback control signal from the video game box by an interface box electrically coupled to a video game chair; and activating a vibrating mechanism coupled to the video game chair in response to the electrical game-controller vibration-feedback control signal intercepted from the video game box.

12. A method as in claim 2, wherein, activating the vibrating mechanism includes activating one or more vibrators, each vibrator being associated with one or more vibration intensity levels and capable of vibrating at a particular vibration intensity level when activated.

13. A method as in claim 11, wherein activating the vibrating mechanism includes activating one or more vibrators, the electrical game-controller vibration-feedback control signal including one or more of a minimum signal, and intermediate signal, and a maximum signal, the minimum signal capable of activating a small number of the one or more vibrators, the maximum signal capable of activating all of the one or more vibrators, and the intermediate signal capable of activating an intermediate number of the one or more vibrators, the small number being at least one, the intermediate number bring equal to or greater than the small number.

14. A method as in claim 11, wherein activating the vibrating mechanism includes activating one or more vibrators included in a game controller.

15. A method as in claim 11, further comprising activating an audio mechanism coupled to the video game chair in response to the electrical game-controller vibration-feedback control signal received from the video game box.

16. A method as in claim 11, further comprising activating a visual mechanism coupled to the video game chair in response to the electrical game-controller vibration-feedback control signal received from the video game box.

17. A method as in claim 16, wherein the visual mechanism includes one or more LEDs.

18. A method as in claim 11, wherein activating the vibrating mechanism includes activating the vibrating mechanism included in an ottoman, the ottoman being included in the video game chair.

* * * * *

UNITED STATES PATENT AND TRADEMARK OFFICE

CERTIFICATE OF CORRECTION

PATENT NO. : 7,273,251 B2
APPLICATION NO. : 11/483307
DATED : September 25, 2007
INVENTOR(S) : James K. Real et al.

It is certified that error appears in the above-identified patent and that said Letters Patent is hereby corrected as shown below:

Col. 4, Claim 8, line 2, delete “on” and in place thereof insert --one--.

Col. 4, Claim 12, line 1, delete “claim 2” and in place thereof insert --claim 11--; and following “wherein” delete “,” (the comma).

Col. 4, Claim 13, line 4, delete “and” and in place thereof insert --an--.

Signed and Sealed this

Fourth Day of December, 2007

JON W. DUDAS
*Director of the United States Patent and Trademark Office*